US005899406A

United States Patent [19]

Payne

[11] Patent Number: 5,899,406

[45] Date of Patent: May 4, 1999

[54] PACKAGING

[76] Inventor: Matt Peter Payne, Bale Hall, Nr. Fakenham Norfolk, United Kingdom, NR21 9DA

[21] Appl. No.: 08/741,834

[22] Filed: Oct. 31, 1996

Related U.S. Application Data

[63] Continuation-in-part of application No. 08/624,424, filed as application No. PCT/GB94/02487, Nov. 11, 1994, abandoned.

[30] Foreign Application Priority Data

Nov. 11, 1993 [GB] United Kingdom ..... 9323272
Aug. 12, 1994 [GB] United Kingdom ..... 9416301

[51] Int. Cl.[6] ..... B65H 21/00; B65H 26/00

[52] U.S. Cl. ..... 242/552; 242/556; 242/556.1; 242/563

[58] Field of Search ..... 242/552, 554.2, 242/556.1, 556, 563

[56] References Cited

U.S. PATENT DOCUMENTS

| | | | |
|---|---|---|---|
| 2,724,426 | 11/1955 | Bell et al. | 156/159 |
| 2,998,204 | 6/1961 | Walsh | 242/554.4 |
| 4,682,038 | 7/1987 | Focke | 250/548 |

FOREIGN PATENT DOCUMENTS

| | | |
|---|---|---|
| 0 445 333 | 9/1991 | European Pat. Off. . |
| 0 490 398 | 7/1992 | European Pat. Off. . |
| 2 193 388 | 2/1974 | France . |
| 28 05 076 | 8/1979 | Germany . |
| 37 27 339 | 2/1989 | Germany . |
| 580 473 | 11/1977 | U.S.S.R. . |
| 1 535 339 | 12/1975 | United Kingdom . |
| 0 167 917 | 1/1986 | United Kingdom . |
| 0 179 243 | 4/1986 | United Kingdom . |
| 2 260 532 | 4/1993 | United Kingdom . |
| 93/12025 | 6/1993 | WIPO . |

*Primary Examiner*—John Q. Nguyen
*Attorney, Agent, or Firm*—Thorpe, North & Western, L.L.P.

[57] ABSTRACT

A reel change apparatus for supplying a webbing material to a downstream machine has two sliding platens that are substantially linearly slidable between a respective standby position and a respective splicing position. Two reel holding members each hold a reeled web in a respective material supply position and a respective wait position. The two sliding platens have clamps for retaining a leading end of a new web. A pivotable platen has a clamp for retaining the trailing end of a running web. Adhesive provided on the leading end is exposed and supported on the sliding platens. The leading end of the new web may be retained on one sliding platen in the respective standby position while a running web passes over the other sliding platen.

25 Claims, 10 Drawing Sheets

PACKAGING

This application is a continuation-in-part of U.S. application No. 08/624,424, filed May 13, 1996, abandoned, which is a 371 of PCT/GB94/02487, filed Nov. 11, 1994.

BACKGROUND TO THE INVENTION

In packaging machines, especially vacuum packaging machines or gas flushed packaging machines, a product is placed on a bottom web of material and covered by a top web. The space between these webs is evacuated or subjected to a gas flushing, and then the webs are welded together and sealed around the product. In some cases, the bottom web is thermoformed to form receiving trays for the product. The webbing material is unwound from a reel which is mounted on the packaging machine. From the reel, the webbing material passes around a number of rollers before it reaches the packaging station. When the material on a reel runs out, it is necessary to replace the existing reel with a new reel, and manually thread the leading portion of the material from the new reel to the packaging station. This operation is time consuming, and leads to a reduction in the productivity of the packaging machine.

EP-A-0179243 discloses an apparatus designed to overcome these problems. The machine supports two reels of webbing material, the webbing material from each reel being guided by a plurality of rollers to a sheet-holder. A separate sheet-holder is provided for each web of material, and the two sheet-holders are arranged in a V-shaped configuration with the surface over which the webbing material runs on each sheet-holder facing the other. In this case, webbing from one reel is supplied over one sheet-holder to a downstream packaging machine, whilst the leading edge of material from the other reel is held on the opposed sheet-holder. As the reel from which material is supplied to the packaging machine is exhausted, the trailing edge is severed by a severing means provided on the sheet-holder, and the sheet-holder is pivoted thereby pressing the trailing edge of the sheet of webbing material onto the leading edge of webbing material held on the other sheet-holder. The two sheets are spliced by use of a pressure sensitive adhesive provided on one sheet. On separation of the opposed sheet-holders, material from the full reel is supplied to the packaging machine. The exhausted reel is then replaced by a new, full reel of webbing material, and operation of the packaging machine continues with no substantial delay for reel changing.

In practice, machines of this type have not enjoyed commercial success. The arrangement shown in EP-A-0179243 requires pressure sensitive adhesive on the leading edge of material to be applied on opposite sides for alternating reels, or for a user to manually add adhesive when the material is held by the sheet-holder. If adhesive is put on the wrong side, the two sheets of webbing material will not join and the new reel of material must be manually fed through to the packaging machine, this being very time consuming.

EP-A-0445333 discloses an apparatus for feeding plastic film for a bag making machine. As with the system of EP-A-0179243, the trailing edge of one reel is joined to the leading edge of a second reel. The problem of adhesive being applied to the wrong side of material on the reel is avoided as the reels are provided on a rotatable arm which rotates about 180° when reels are changed. This ensures material in the wait position is always arranged with the adhesive surface facing the same direction. The disadvantage of this system is that, for packaging machines, the reels are typically of a large diameter and therefore a system in which a supporting arm is rotated requires a large area to operate. This area is generally not available for commercial packaging lines.

Another option which has been proposed is to join two rolls of webbing material by welding rather than using an adhesive. This has not been generally accepted as a commercially useful method, due to technical problems and cost considerations.

SUMMARY OF THE INVENTION

An object of the present invention is to provide a method and apparatus for splicing successive webs of material for feeding into a machine, such as a food-packaging machine, in which the webs from successive reels are always spliced in the same orientation. It is a further object of the invention that the apparatus is of compact size and simple construction and is easy and convenient to use. The invention thus aims to reduce machine downtime caused by changing and splicing reels of webbing material, particularly in relation to machines on food-packaging production lines.

According to the present invention, a reel change apparatus comprises two reel holding means, each arranged to hold a reel of webbing material, one in a material supply position and the other in a wait position, a first set of rollers arranged to guide the webbing material from the reel in the material supply position over a first platen and towards a downstream machine, such as a packaging machine, a second set of rollers arranged to guide webbing material from the reel in the wait position to a second platen, each platen including a means for retaining the leading end of the webbing material on the platen such that an adhesive provided on the leading end of material in the wait position is exposed, and is supported by the platen, and a third platen pivotally mounted downstream of the first and second platens, arranged to hold the trailing end of webbing material from the material supply position and being pivotable to bring the trailing end of material from the reel in the supply position into contact with the leading end of the material from the reel in the wait position, thereby sandwiching the adhesive between the two pieces of webbing material thereby joining these, and subsequently to release the joined portion of the webbing material.

Advantageously, each of the first and second platens is slidably mounted for translation between two respective positions, a standby position spaced from the third platen in which the leading edge of the web from the reel in the wait position can be clamped to the respective first or second platen, and a splicing position in which the leading edge of the web in the wait position can be spliced to the trailing edge of the running web (the web running into the downstream machine), which is clamped to the third platen for splicing.

The invention thus allows all reels of webbing material to have an adhesive applied on the same surface of the material, yet allows the joining of webbing material by merely pressing the two pieces of material together. This system is therefore much less complicated than the prior art.

The final running directions of the webs from the two reel positions towards the third platen are preferably separated by a small, acute angle. The angle is advantageously less than 50°, preferably between 30° and 45° and particularly preferably about 40°. This allows the apparatus to be of compact size and places the standby positions of the first and second platens conveniently relatively close together. The leading end of a new web from either reel, when that reel is in the wait position, is always clamped to a sliding platen in its standby position. If the standby positions of the sliding platens are closely spaced, then an operator advantageously only requires access to one portion, or area, of the apparatus (the area of the two standby positions). That portion or area is preferably spaced from the splicing means. Ease and safety of operation may thus be enhanced.

The final running directions of the webs from the two reels towards the third platen are usually defined by fixed rollers over which the webs run. Advantageously the first and second platens slide along directions set at a very small angle (advantageously less than 10°, or about 6°) to the final running directions of the respective webs. This is for the following reason. When a sliding platen is in its active position, in which two webs are spliced, or pressed, between the sliding platen and the third platen, the sliding platen must be aligned with the running direction of the web. When the sliding platen is in its standby position, it is advantageous if it is spaced from the running web in order to avoid the moving web being scuffed or scratched by contact with the sliding platen. This may be achieved by setting the direction along which the sliding platen slides between its active position and its standby position at a small angle to the running direction of the corresponding web, with the sliding direction intersecting the running direction at the active position.

Similarly, to avoid scuffing or scratching of the running web, the third platen may advantageously be raised clear of the web while the web is moving.

Preferably, each of the three platens includes a vacuum clamp which can hold the end of webbing material on the platen, whilst exposing the end of the material. This is particularly advantageous for handing thin, flexible web materials. Additionally, it is advantageous if the platens include a secondary clamp. This additional clamp may be a mechanical clamp, such as an offset roller or an offset bar. The additional clamp is particularly useful where the web material is heavy, as the vacuum clamp may then be insufficient to hold the web securely. The additional clamp should be arranged to hold the material at a position spaced from the vacuum clamp. For some web materials, such as thick, stiff, materials, only the mechanical clamp may be required, and the vacuum clamp may be omitted.

An end detector may be provided to detect the end of material from the reel in the supply position. The end detector may be in the form of an optical sensor, such as a photo-electric emitter and detector provided on opposite sides of the webbing material, or a photo-electric emitter and detector arranged to monitor the amount of material remaining on the reel. Alternatively, the end detector may be in the form of a tactile sensor provided to detect the absence of webbing material. In any case, when the end detector detects the end of a reel, it is preferred that an alarm is sounded, or a light illuminated, to alert a user to initiate the joining of the two pieces of webbing material.

It is preferred that the adhesive is in the form of a strip across the width of the webbing material, and that it is protected prior to use by a cover strip.

Where the apparatus of the invention is used for splicing webbing material for feeding a vacuum-packaging or gas-flushed-packaging machine, the packaging machine itself typically has a means for monitoring the integrity of packages by monitoring the gas pressure within each package. In particular in food-packaging applications, it is desirable that the spliced portion of webbing material does not form part of a package dispensed to a consumer, since this includes adhesive and may not give the required protection for the product from the environment. In a preferred aspect, the invention therefore provides a means associated with one or more platens to puncture holes through the webbing material in the region of the splice so that the food packages formed using the spliced area will not be sealed and will automatically be rejected by the equipment which monitors the integrity of the packages. Alternatively, the adhesive used for the splice may not be continuous across the material, for example being in the form of an intermittent strip. In the same way as holes in the webbing material, this produces a non-gas-sealed package which can be detected and rejected.

Advantageously, the apparatus includes a guillotine or slicing means for cutting the trailing end of the running web prior to joining it to the leading end of the material from the reel in the wait position.

In a preferred embodiment, the apparatus of the invention advantageously requires substantially no back and forth movement of the web downstream of the splicing head during splicing. No accumulator or end-link adjuster is then required between the splicing apparatus and the packaging machine to accommodate web motion during splicing. This contrasts with prior art machines in which significant web movement may occur during splicing, undesirably necessitating the cost and inconvenience of installing an accumulator or end-link adjuster.

As preferred, the operation of the splicing apparatus may be manual, or partly or fully automated. Interlocks on the moving parts of the apparatus may be provided to ensure that an operator carries out the necessary operations in the correct order. The interlock system may advantageously be linked to the packaging machine itself to ensure that the packaging machine stops and starts as required during splicing.

DESCRIPTION OF DRAWINGS

Preferred embodiments of the reel change apparatus according to the present invention will be described with reference to the accompanying figures in which.

Figure 1:
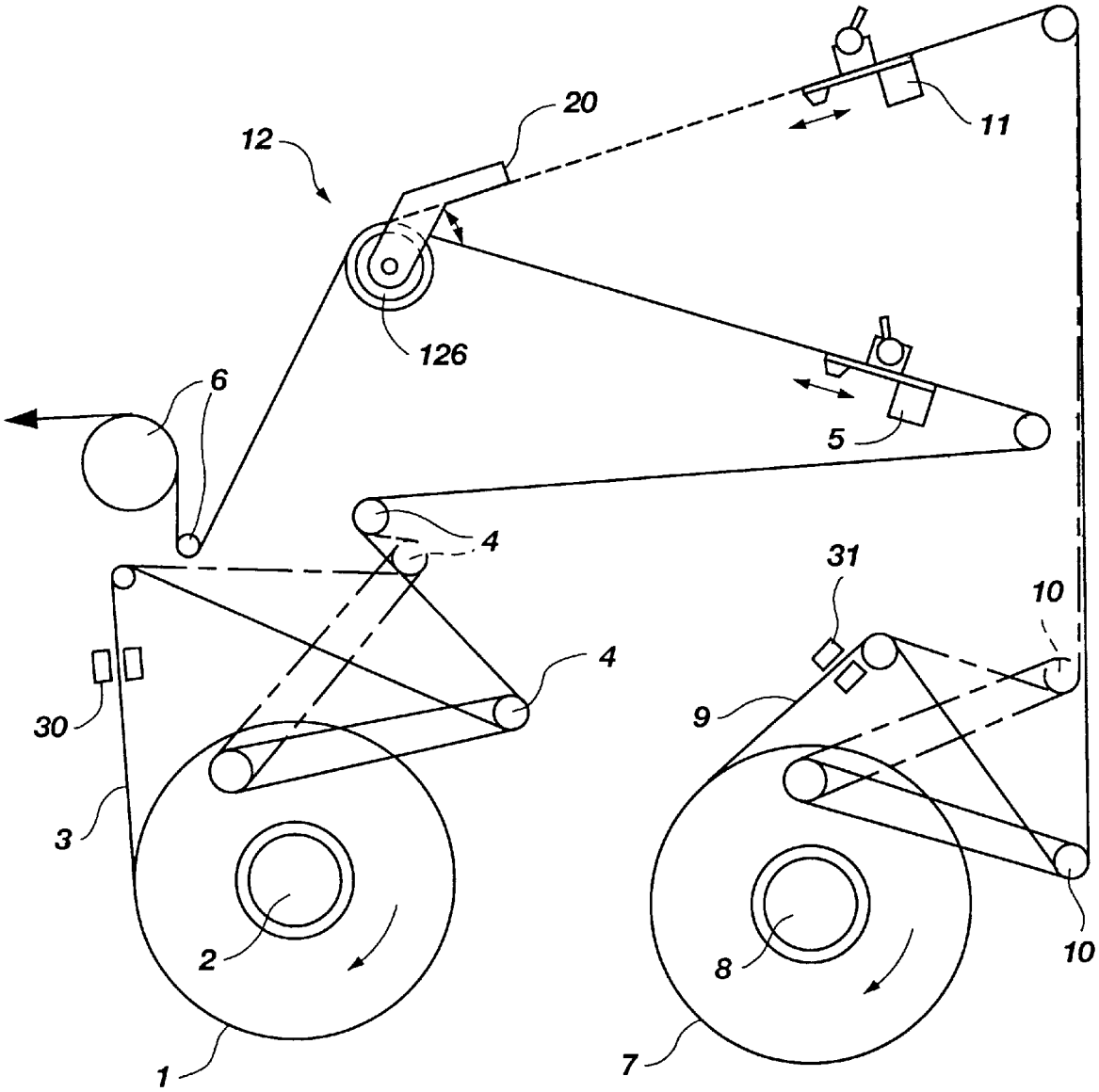
FIG. 1 is a schematic side view of a first embodiment of a reel change apparatus.

The first embodiment, illustrated in FIG. 1, shows a specific example of an arrangement for changing reels for a bottom web of a vacuum packaging machine. A first reel 1 of webbing material is rotatably mounted on a spool 2. The webbing material 3 from the first reel 1 forms the running web and is threaded around a plurality of idler rollers 4 over a first platen 5, through a splicing means 12, and on through further rollers 6 to the vacuum packaging machine. The idler rollers 4 are spring-biased into the positions shown in solid lines. When material is not being drawn by the downstream packaging machine, the rollers 4 take up slack material. When material is being drawn by the downstream machine, this taken-up material is used first, as the rollers 4 move against the action of the springs. The rollers and the web can thus move to the positions shown by dotted lines in FIG. 1. This system prevents jerking of the reel of webbing material. The idler rollers thus form an accumulator or end link adjustor. Initially, the spool 2 constitutes the material supply position. The vacuum packaging machine draws webbing material 3 from the reel 1 in the material supply position as required. This forms the running web.

Figure 2:
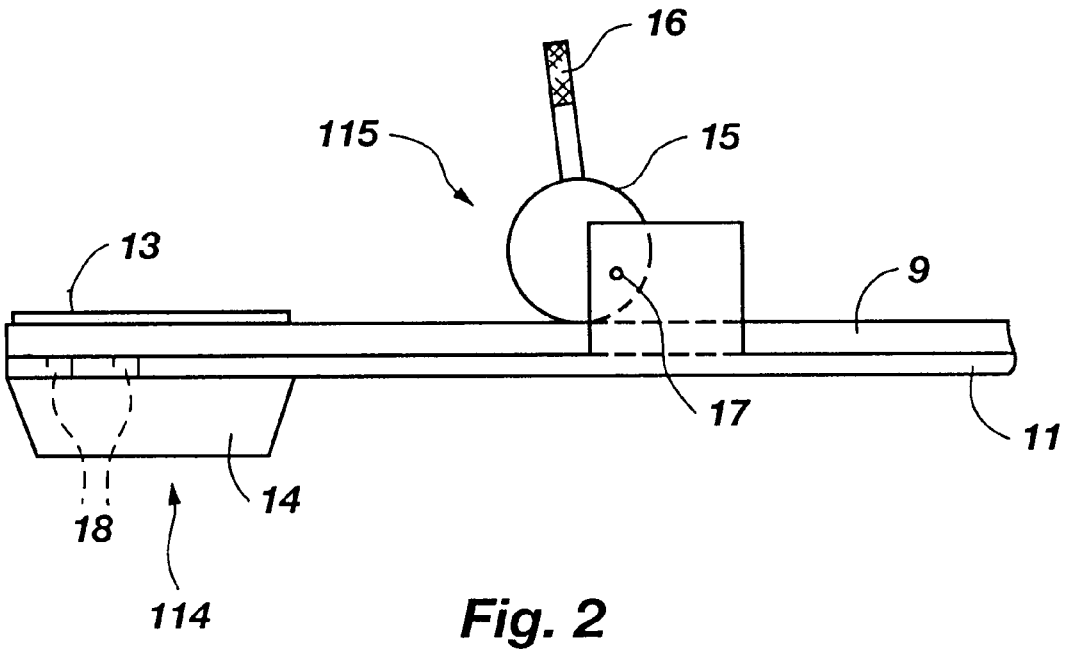
FIG. 2 shows a side view of a first or second platen of the first embodiment.

A second reel 7 of webbing material is provided on a second spool 8. Initially, the second spool constitutes the wait position. Webbing material 9 from the second reel 7 is threaded around a number of cantilevered idler rollers 10, and over a second platen 11. The leading end of the webbing material 9 from the second reel 7 is provided with an adhesive strip 13 which is covered by a cover strip (not shown). The adhesive 13 is provided on the inner side of the material on the reel to protect it prior to use. The leading end of the material 9 is held on the platen 11 by clamps, 114, 115, as best shown in FIG. 2. FIG. 2 shows two clamps, a vacuum suction clamp 114, and an offset roller clamp 115. The offset roller clamp 115 comprises an offset roller 15 which is rotated by an arm 16 around a pivot 17 offset from the axis of the roller 15, thereby pinching the material 9 and holding it in place. The roller 15 is provided upstream of the end of the platen 11 so that the adhesive strip 13 on the material 9 is exposed. The vacuum suction clamp 114 comprises a number of holes 18 provided through the platen 11 and connected via a vacuum chamber 14 and a vacuum line to a remote vacuum pump, and holds the material 9 on the platen 11. This is particularly useful to prevent the leading edge of the material 9 from curling up when the cover strip is removed.

The construction of the first platen 5 is the same as that of the second platen 11 described above. However, in the operating phase of the reel change apparatus illustrated in FIG. 1 both the vacuum suction clamp and the offset roller clamp of the first platen 5 are in the released, or unclamped, position so that the running web 3 can run freely over the first platen 5 into the packaging machine.

Figure 3:
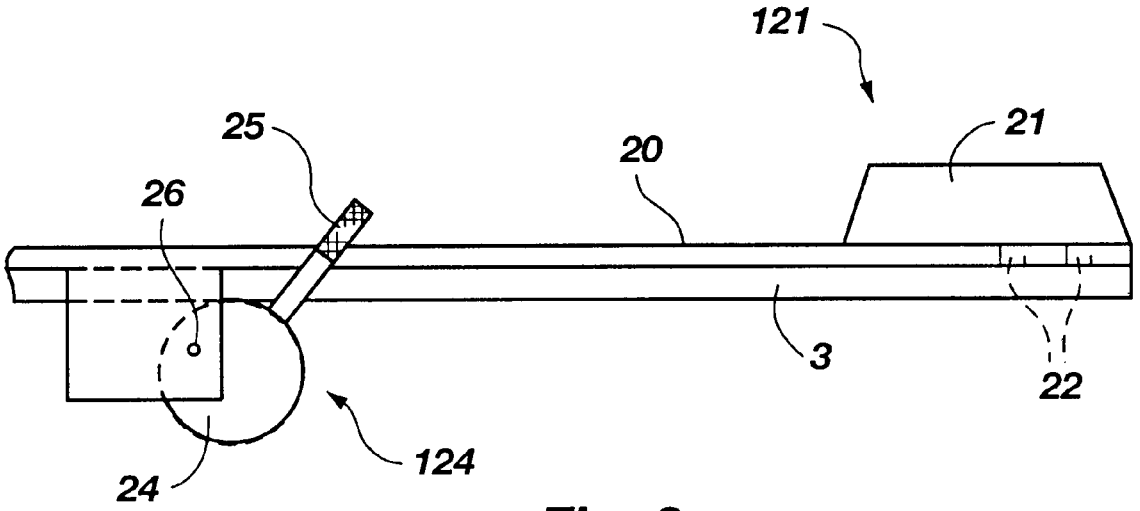
FIG. 3 shows a side view of a third platen of the first embodiment.
Figure 4:
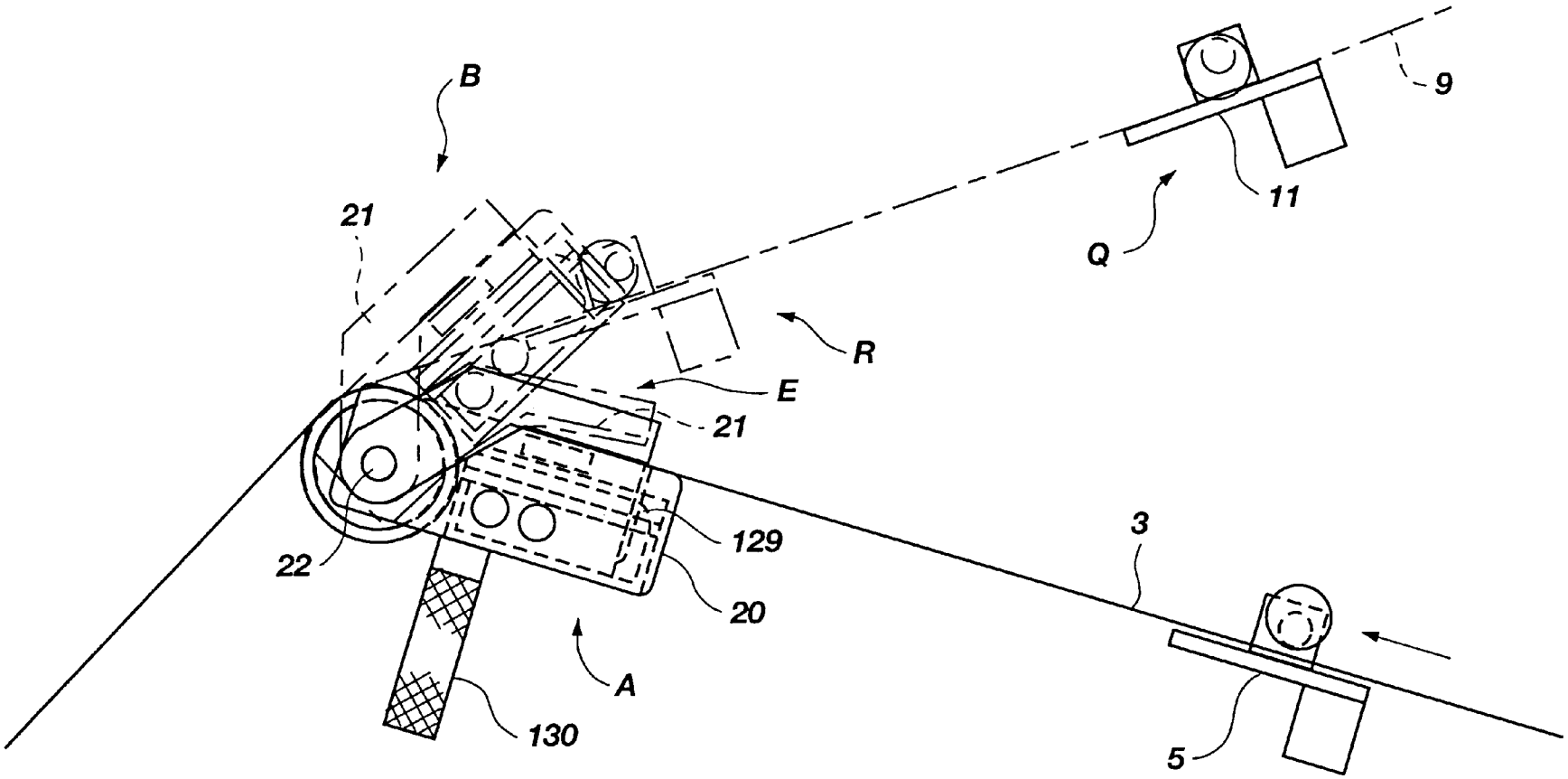
FIGS. 4 and 5 show the mechanism in the first embodiment for joining two sheets of webbing material.

A photoelectric sensor 30 detects when the webbing material 3 on the first reel 1 has nearly run out, typically where there is only sufficient material for a further two to three minutes of operation of the packaging machine. In one example, the photo-electric sensor 30 may be a photo-emitter and detector arranged either side of the webbing material. By providing a portion near the end of the material wound on the reel with a different translucence compared to the rest of the material, a change in the light transmitted through the material will indicate the end of the reel. Alternatively, the photo-electric sensor may monitor the diameter of the reel, and indicate the end of the reel when the reel radius is below a predetermined level. A tactile sensor may be provided in place of or in addition to the photo-electric sensor, and in this case will detect the absence of material or the reduction in the radius of the reel of material below a predetermined level. At this point, a warning light on the machine is illuminated, or an audible alarm sounded, to indicate to an operator that material is shortly to run out. The operator then removes the cover strip covering the adhesive strip 13 at the leading end of the material 9 from the reel in the wait position, held on the second platen 11. The running web 3 is then clamped to a third platen 20, shown best in FIG. 3, which forms part of the splicing means 12. The third platen includes a vacuum clamp 121 which clamps the material from above, leaving the underside exposed. The vacuum clamp 121 is generally similar to those of the first and second platens, a vacuum being drawn through holes 22 in the platen 20 and into a vacuum chamber 21. An offset roller clamp 124 may also be provided to provide additional clamping, a roller 24 being pivoted around an offset pivot 26 by an arm 25. The clamped material 3 is cut using a guillotine 129 (FIG. 4) provided on the splicing means 12 to give a square edge with no excess material.

When the trailing end of the running web 3 is clamped it may be necessary to stop the packaging machine itself while a new web is spliced. The splicing process of the invention is advantageously quicker than prior art reel-changing processes conventionally used in food-packaging production lines, but if it is desirable not to stop the packaging machine, a web reservoir may be provided between the splicing apparatus and the packaging machine in known manner. It should be noted that because the splicing process of the invention is quicker than conventional processes, the web reservoir may hold less webbing material and so may be advantageously smaller than with conventional processes.

The third platen 20 is pivotable about an axis 22 and incorporates a roller 126 for guiding the running web. The platen surface of the third platen is upstream of and aligned with the roller surface. Each of the first and second platens 5, 11 is slidably mounted, for example on a respective pair of parallel runners. Each can be slid between two positions, a standby position and a splicing position. Both the first and second platens are shown in their respective standby positions in FIG. 1.

In the standby position each sliding platen is spaced from the third platen and is conveniently accessible for an operator to clamp the leading end of the web in the wait position thereto. In the splicing position each sliding platen is positioned so that by pivoting the third platen, by means of a handle 130, the platen surfaces of the third platen and the sliding platen can be brought into abutment and pressed together. The sliding platens thus slide along different respective directions, at an angle to one another but both tangential to the guide roller of the third platen. The angle between the sliding directions is advantageously a small, acute angle, to allow the splicing apparatus to be of compact size.

In FIG. 1, the running web 3 is drawn from reel 1 on spool 2. When the photo-electric sensor detects the end of reel 1, the web 9 from the other reel 7 on spool 8, the wait reel, is spliced to the end of the running web as follows. The third platen 20 is pivoted upwards about the pivot 22 from its initial position A (see FIG. 4) to a raised, inclined position B, shown in phantom in FIG. 4. The second platen 11 is slid from its standby position Q to a ready or splicing position R (shown in phantom in FIG. 4) below the third platen 20, so that the adhesive tape 13 on the leading end of the new web 9 is exposed below the trailing end of the running web 3 feeding to the packaging machine. The platen 20 is then pivoted downwards to press the trailing end of the web 3 onto the leading end of the web 9, thereby sandwiching the adhesive 13 between the two lengths of webbing material and splicing these together. The clamps on the second and third platens 20 are released, and the material from the second reel 7 becomes the running web and is drawn into the packaging machine as required. At this time, the second spool 8 becomes the material supply position, and the first spool 2 becomes the material wait position.

It should be noted that after the leading end of the new web is clamped to the second sliding platen 11, it is only drawn forwards during splicing (from position Q to position R). No backwards movement of the new web occurs so the web advantageously cannot become slack during splicing.

The second platen can be slid back to its standby position either before the clamps on the third platen are released or after the running web has started to be drawn into the packaging machine.

Figure 5:
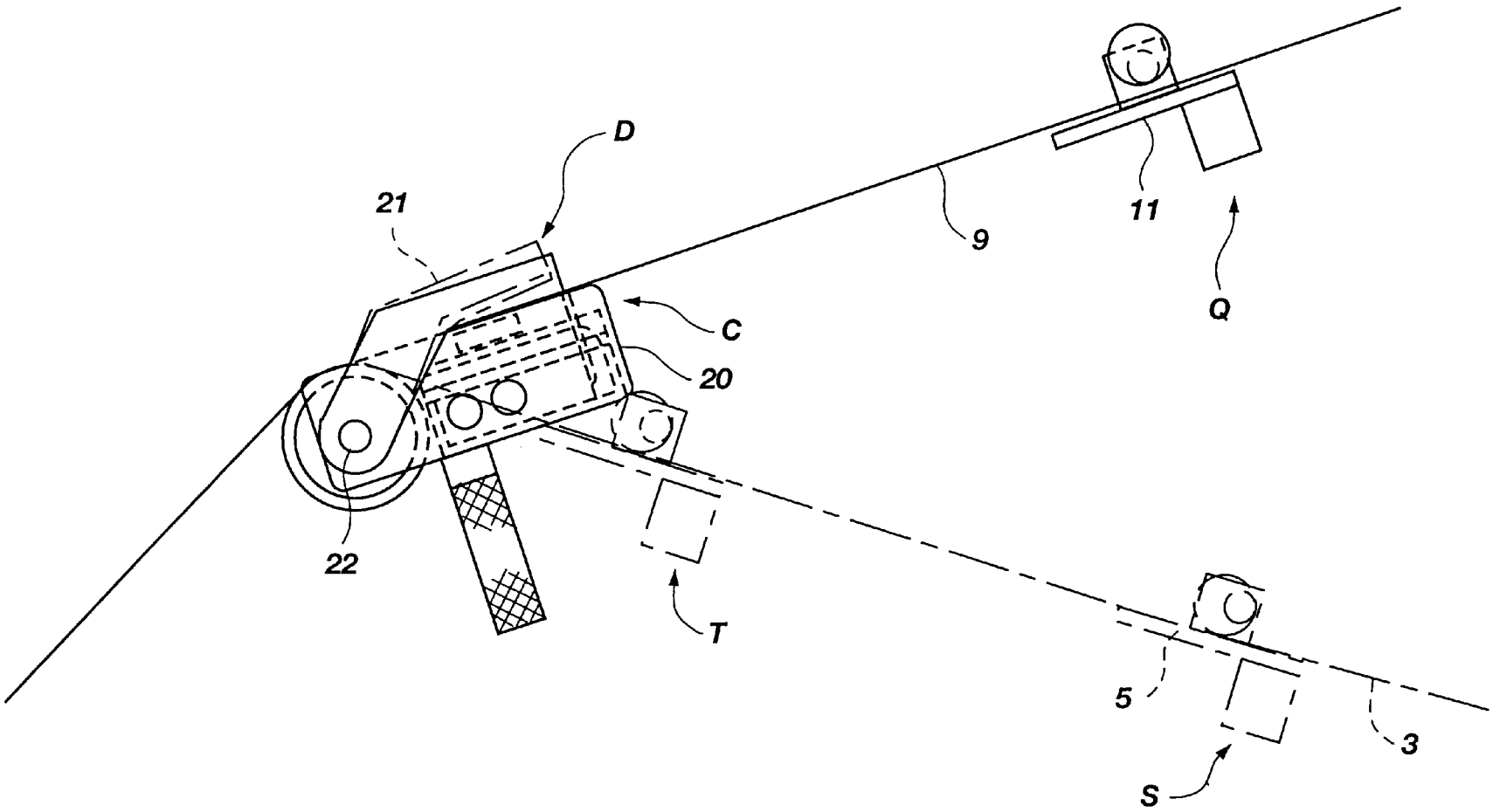
Figure 6:
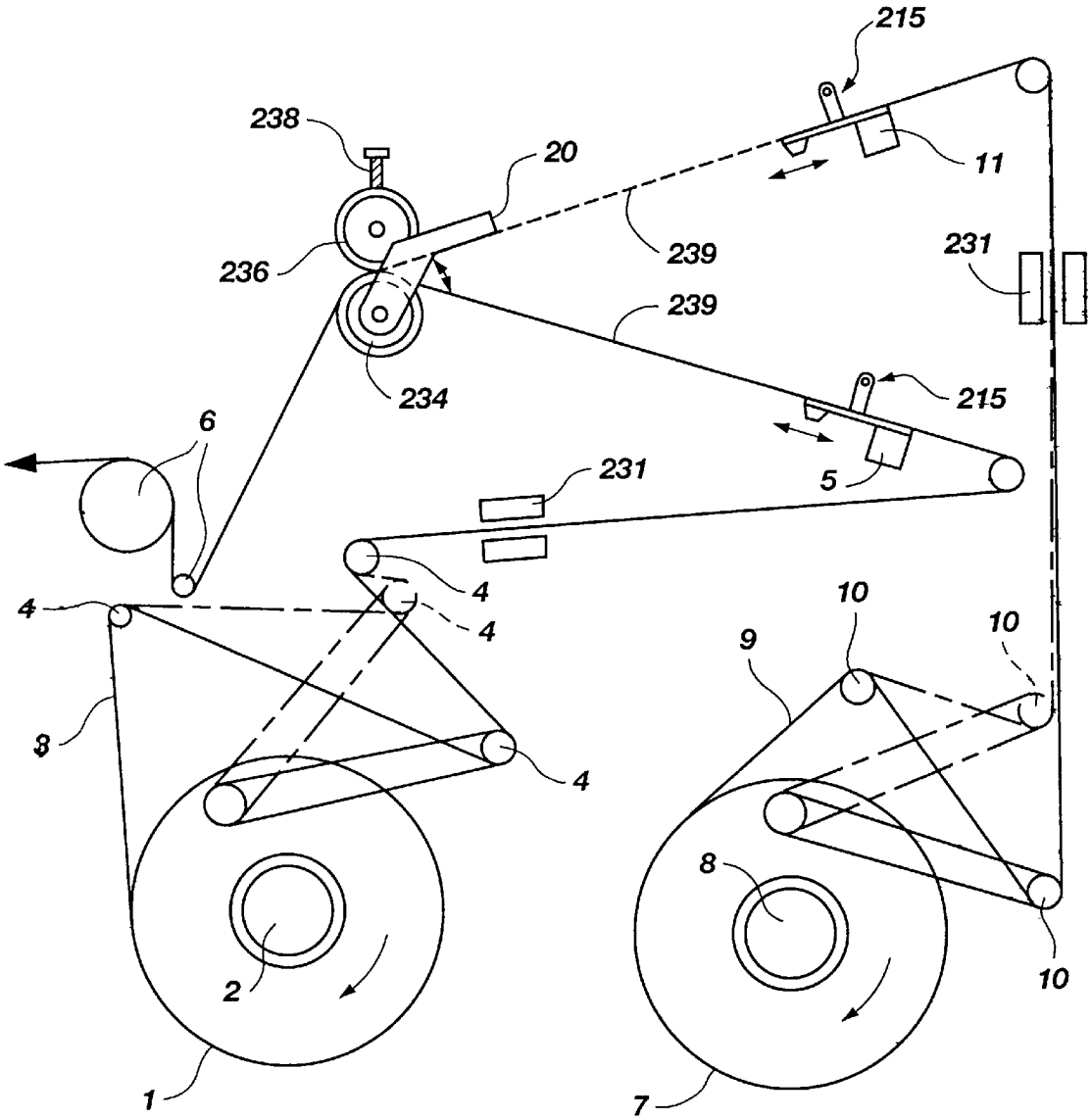
FIG. 6 is a schematic side view of a second embodiment of a reel change apparatus.
Figure 7:
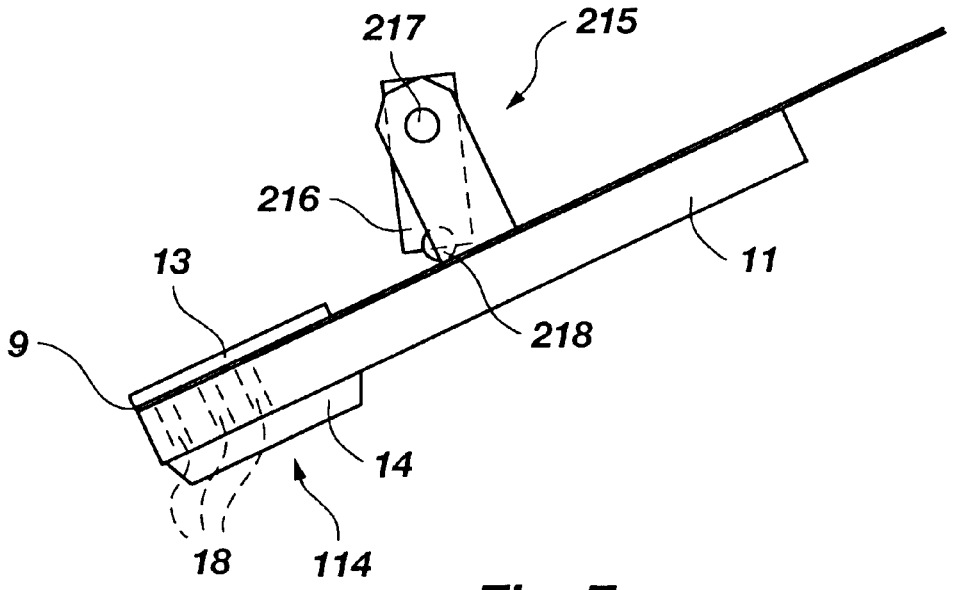
FIG. 7 is a diagrammatic side view of a first or second platen of the second embodiment.
Figure 9:
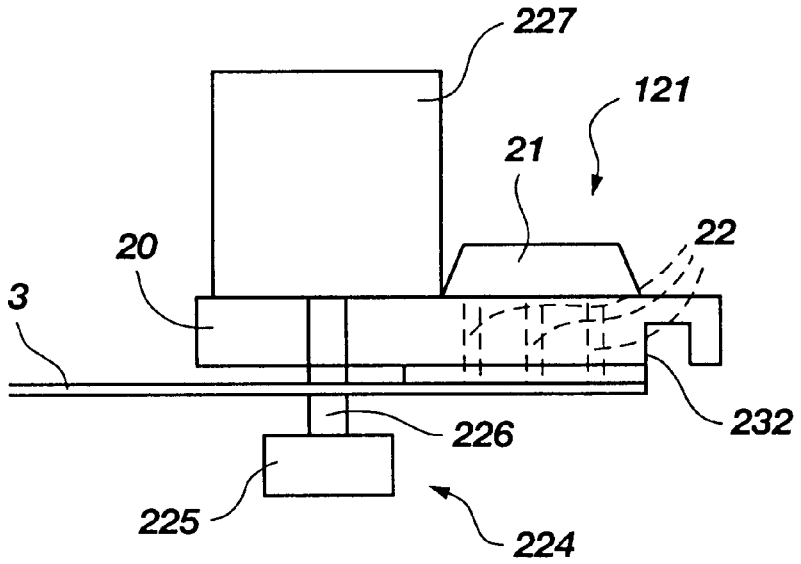
FIG. 9 is a diagrammatic side view of a portion of the third platen of the second embodiment.
Figure 8:
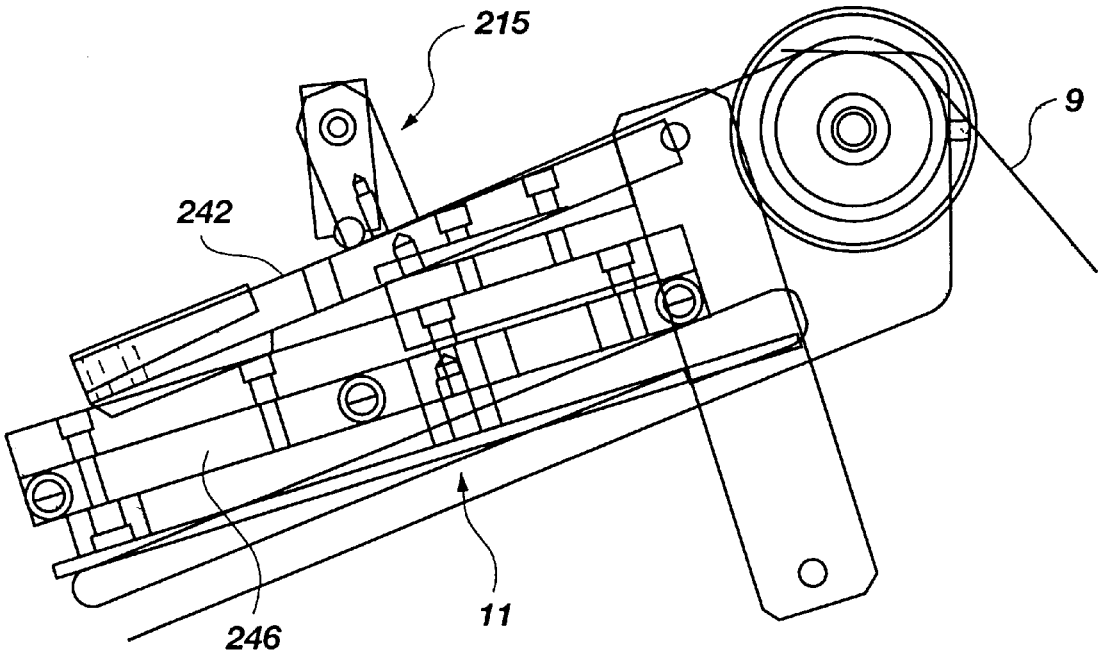
FIG. 8 is a sectional side view of the first or second platen of the second embodiment.
Figure 10:
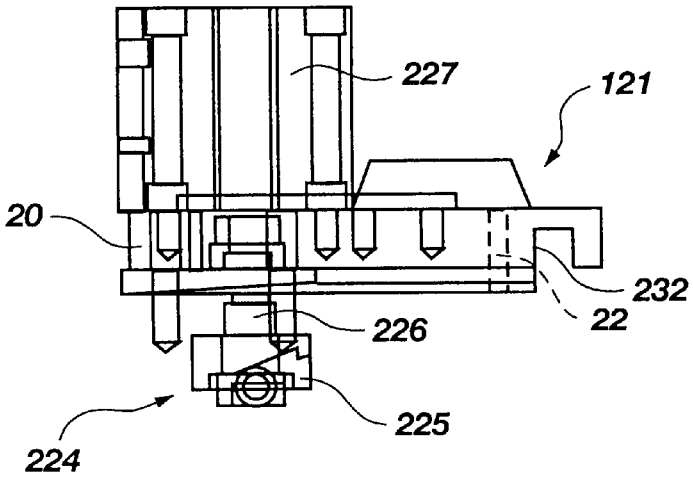
FIG. 10 is a sectional side view of the third platen of the second embodiment.

FIG. 5 shows the platen positions while the new web is running. The second platen is in its standby position Q with its clamps released. The third platen is raised slightly from position C (the splicing position) to position D (shown in phantom) so that the platen surface is slightly spaced from the running web. This reduces friction and wear. The first platen is in its standby position S.

The empty reel 1 is removed from the spool 2, and a new, full reel of webbing material is placed on the spool 2. The webbing material 3 from this reel 1 is fed around the idler rollers 4 to the first platen 5, where it is held in position by clamps means similar to that described for the second platen 11. The end of the material 3 is provided with an adhesive strip covered by a cover tape, this also being originally positioned on the inner surface of the material on the reel. All the reels of webbing material may thus advantageously be identical, regardless of which spool 2 or 8 they are to be mounted on.

FIG. 5 shows the splicing of reels when spool 2 constitutes the material wait position. A photodetector 31 (FIG. 1) alerts the operator to the impending running out of the webbing material 9 from the reel 7. The operator then removes the cover strip from the leading end of the material 3 held on the first platen 5 in position S. The material 9 provided to the packaging machine is clamped onto the platen 20 of the splicing means 12 (which is lowered to position C for this purpose), and the trailing end of the material 9 is cut with the guillotine. The first platen 5 is slid to its splicing position T below the splicing means 12 with the exposed adhesive tape facing upwards. The platen 20 is pivoted downwards (to position A in FIG. 4) to sandwich and press the trailing end of the material 9 onto the adhesive strip on the leading end of the material 3, thereby splicing the two lengths of webbing material. The material is released from the first and third platens 5, 20, and material is drawn into the packaging machine from the reel 1. The third platen is raised slightly to position E (see FIG. 4) while the web is running. At this stage the spool 2 again constitutes the material supply position, and the second spool 8 constitutes the material wait position. A new reel of webbing material 7 can be mounted on the second spool 8 and fed around the rollers 10 to the upper platen 11 as in FIG. 1, thereby allowing the process to be repeated.

As noted above with regard to the splicing operation in which the new web is carried by the second sliding platen 11, when the new web is carried by the first sliding platen 5 similarly only forward movement of the new web occurs. Advantageously, the new web cannot therefore become slack during splicing.

It should also be noted that because the sliding directions of the first and second platens may be separated only by a small angle, the rotation angles of the third platen about its pivot during splicing can similarly be small. This leads to the advantage that back and forth movement of the running web while its trailing end is clamped to the third platen may be very small.

In fact, as described below in relation to the second preferred embodiment, the apparatus of the invention may be implemented so as substantially to eliminate back and forth movement of the trailing end of the running web during splicing.

A second embodiment is illustrated in FIGS. 6 to 12. The second embodiment is similar to the first in its basic layout and operation but contains a number of advantageous and different features. Features of the second embodiment common to the first embodiment have been given the same reference numbers in FIGS. 6 to 12 as in FIGS. 1 to 5 and will not be discussed in detail again.

In the second embodiment, end-of-web sensors 231 are positioned next to the respective web portions downstream of the two sets of idler rollers 4, 10. This improves the reliability of end-of-reel detection because these portions of the webs undergo less lateral movement as the respective reels empty than the web portions adjacent the reels, on which the end-of-reel detectors 31 are placed in the first embodiment.

In the second embodiment, the mechanical clamps on each platen differ from those in the first embodiment. On each sliding platen 5, 11 in the second embodiment, a clamp 215 comprises a weighted (or spring-loaded) crank arm 216 on each side of the platen pivoted in a pivot bearing 217 supported at a fixed spacing above the platen surface. A rubber strip 218 extends transversely across the platen between the ends of the weighted arms distant from the pivots. The distance from the pivots to the platen is less than the distance from the pivots to the distal edge of the rubber strip so that, in use, the rubber strip rests on the web on the platen (urged either by gravity or by springs if required) and allows the web to move forwards across the platen but prevents it from being drawn backwards.

The clamp 215 thus acts as a one-way clamp and may therefore be left in place at all times, even while the web is running. Alternatively it may be lifted off the web by pivoting the arms about the bearings 217. A stop may be provided to retain the clamp in a disengaged position. This may be advantageous when the web is of a sensitive film or of material which may be scuffed by the clamp.

The third platen in the second embodiment is provided with a clamp 224 which comprises a transverse bar 225 attached at each end via a pull rod 226 to a pneumatic actuator 227 (or any other suitable actuator). The clamp is engaged by the actuator urging the transverse bar against the web to clamp the web 3 against the platen 20. This arrangement is advantageous because it can be operated automatically and because it does not need adjustment for different web thicknesses.

Figure 11:
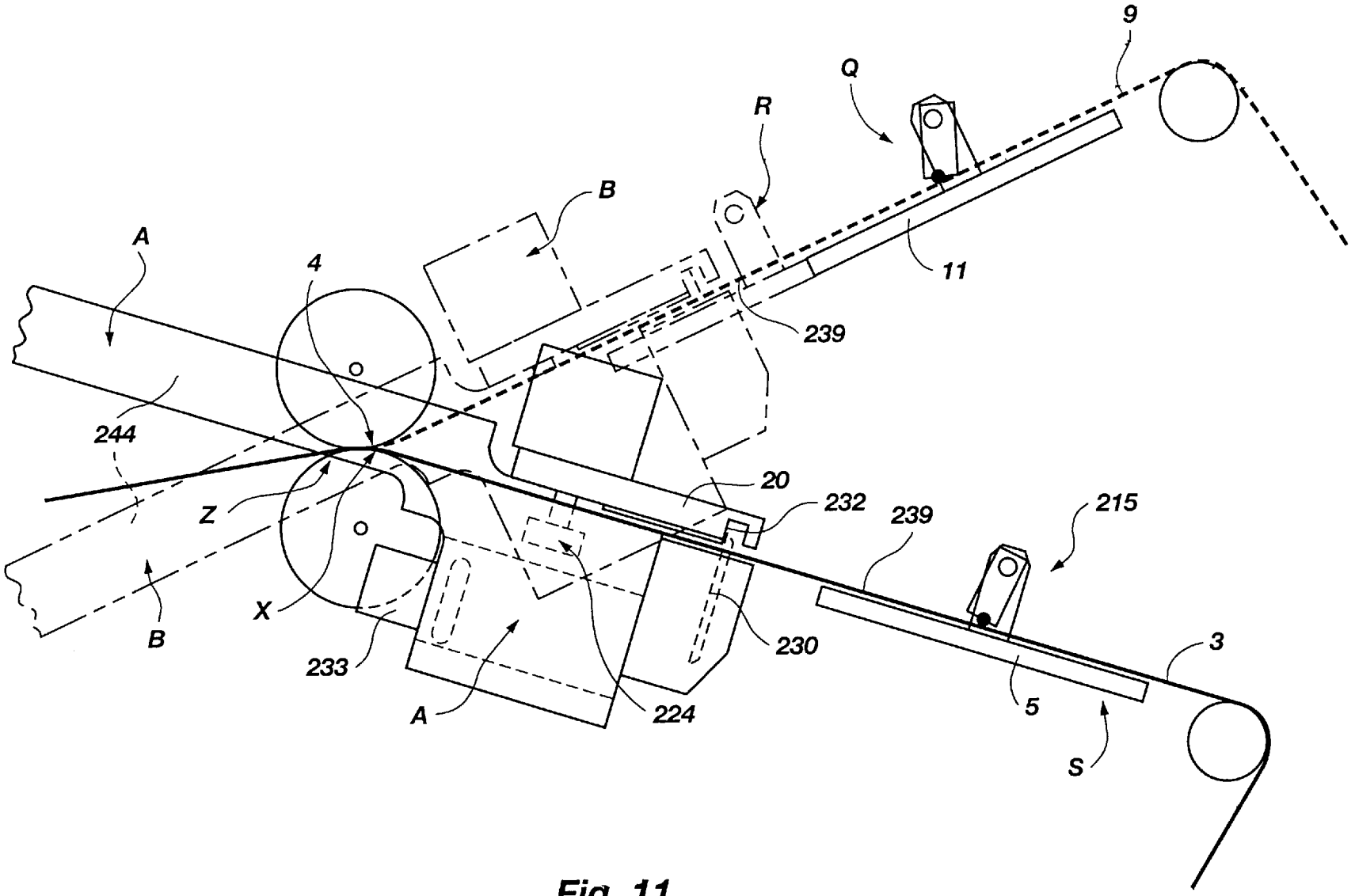
FIG. 11 is an illustration of the operation of the second embodiment.
Figure 12:
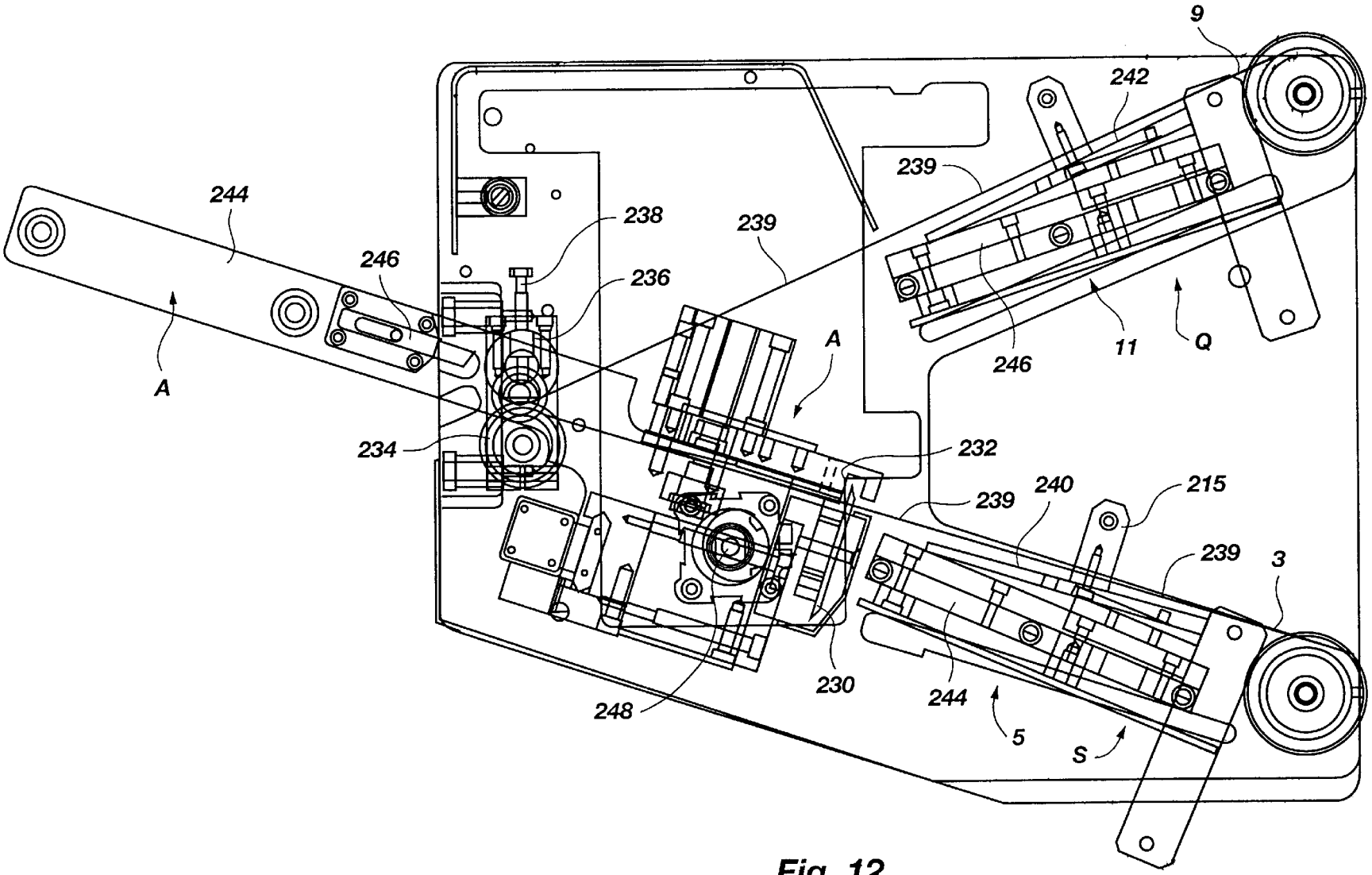
FIG. 12 is a sectional side view of the second embodiment.

The third platen of the second embodiment comprises a rotary knife 230 for cutting the trailing end of the running web 3 before splicing. This is shown in FIGS. 11 and 12 and acts against a transverse cutting edge 232 of the platen 20. The knife runs in a recess in the platen, both for operator safety and to protect the knife and cutting edge 232 from damage. The knife is driven by a pneumatic actuator 233 (or any other suitable means) and traverses the platen to cut the web. The knife may operate automatically after the clamp 224 has operated automatically to clamp the trailing edge of the running web. In practice, in an automated splicing apparatus, an end-of-web detector 231 preferably sends a signal to stop the packaging machine and the packaging machine sends a signal back to the splicing apparatus once it has stopped. The clamp 224 operates in response to the signal from the packaging machine and then the knife cuts the web.

The second embodiment comprises a pair of nip rollers 234, 236 between which the web runs from the splicing apparatus to the packaging machine. The nip rollers perform two functions. First, the gap in which the web runs between the rollers is adjustable and is preferably set to a distance greater than the web thickness but less than twice the web thickness. Thus, when the splice between two webs passes between the rollers, it is compressed, to ensure a firm adhesive bond between the webs. The upper roller is rubber-coated and its mounting is spring-loaded so as to apply the necessary pressure to the adhesive bond. By contrast, a single thickness of web can pass between the rollers without pressure being applied. The gap between the rollers is adjustable by means of adjusting screw 238 which varies the position of the upper roller 236.

The second function of the nip rollers is to minimise back and forth movement of the web during splicing. The nip rollers are positioned such that the gap between the rollers extends transversely across the web, and is parallel to and adjacent to the pivot axis of the third platen. In addition, the rollers preferably have substantially equal radii and the roller axes are parallel and both lie in a plane perpendicular to the plane bisecting the angle between the portions 239 of the running webs approaching the third platen. In the embodiment illustrated in FIG. 12, the portions 239 of the running webs approaching the third platen are substantially equally spaced above and below the horizontal and therefore the roller axes are vertically spaced.

Thus, if the third platen is in its lower position A, as shown in FIG. 11, and the running web is supplied from the lower position 3, then as the web enters the gap between the nip rollers, it is wrapped for a short distance X around the bottom nip roller 234. When the running web ends, its trailing edge is clamped to the third platen and the third platen is pivoted from its lower position A to its upper position B (shown in phantom in FIG. 11). As the third platen pivots, the web unwraps from the bottom nip roller 234 and then wraps for a short distance Y around the upper roller 236. As the third platen pivots, very little movement of the web downstream of the nip rollers occurs. No web accumulator is therefore required between the splicing apparatus and the packaging machine to accommodate such movement. It can readily be seen that it does not matter whether the web downstream of the nip rollers is horizontal or inclined (with reference to FIG. 12). If it is inclined, the web Z simply wraps around one of the nip rollers as required.

In the Summary of the Invention above, reference was made to the advantages of the sliding directions of the first and second platens being arranged at a small angle to the running directions of the respective webs over those platens. This feature is illustrated in FIG. 12, in which the structure of each sliding platen 5, 11 is shown in more detail. Each platen is shown in FIG. 12 in its standby position, in which the respective splicing surfaces 240, 242 are spaced from the running line 239 of the respective web. Each sliding platen slides on runners 244, 246 along fixed, inclined shafts (not shown). When a new reel is loaded into the apparatus, the leading end of the web is clamped to the splicing surface, or platen surface, of the appropriate sliding platen in its standby position. At this point, the web is slightly displaced from its eventual running direction 239. When the new web is to be spliced to the trailing end of an old web, the sliding platen is moved forwards to its active position and, because of the inclined sliding direction, the platen surface and the web clamped thereto rise onto the running web direction 239. After the webs have been spliced, the sliding platen is withdrawn to its standby position and, because of the inclined sliding direction, drops away from the web running direction so as to prevent scuffing by the web as the web is drawn into the packaging machine.

The sliding platens may advantageously comprise resilient splicing surfaces at the forward ends of the respective platen surfaces. These are advantageously made of rubber and incorporate air passages to enable the vacuum clamps to operate.

In a preferred embodiment, the operation of the second embodiment of the splicing apparatus illustrated in FIGS. 11 and 12 is as follows. The running web is initially the lower web 3, so that the third platen is in its lower position A. The clamp 224 on the third platen and the clamp 215 on the lower sliding platen 5 are released. The third platen surface is raised slightly above the web running direction and the sliding platen 5 is spaced slightly beneath the web running direction. The web can therefore move freely, without scuffing, through the splicing apparatus. When the web detector 31 detects the end of the web, a signal is sent to the packaging machine. In response to the signal, the packaging machine stops. (This may be after a short delay to allow the remainder of the running web to be used. This depends on the position of the end-of-web detector.) When it has stopped, the packaging machine sends a signal to the splicing apparatus which causes the mechanical clamp 224 and the vacuum clamp 121 on the third platen to operate and to hold the running web to the platen surface. The knife 230 is then automatically driven across the third platen to cut off the trailing end of the running web. A light is then illuminated, or a buzzer sounds, to alert the operator of the splicing apparatus to carry out the splicing operation.

The operator moves the third platen by means of a handle 244 from its lower position A to its upper position B. First, however, the operator must release a spring loaded clip 246 which locks the third platen in one of its two positions A, B. In addition, for safety, an automatic locking device 248 may be provided which locks the third platen in position until the knife has cut the trailing end of a running web and the operator has been alerted. The operator raises the third platen and engages the clip 246 so as to hold the third platen in position B. The leading end of a new web has already been clamped to the platen surface 242 of sliding platen 11 in its standby position Q. This was done at the end of the previous splicing operation. The new web carries an adhesive strip on its upper surface at the front of the sliding platen 9. The operator removes the cover strip and slides the sliding platen forwards to its active position R (shown in phantom in FIG. 11). The clip 246 holds the third platen in a slightly elevated position above the final running direction 239 of the web, so that clearance is provided to move the sliding platen beneath the third platen. The operator then releases the clip 246 and presses the third platen downwards against the sliding platen, thus pressing the trailing end of the running web against the adhesive strip. The operator then releases the clamps 224, 121 on the third platen and raises the third platen slightly so that the clip 246 engages. The operator then releases the clamps on the sliding platen and withdraws the sliding platen to its standby position Q. The operator then loads a new reel into the reel-changing apparatus and clamps the leading end of the new reel to the other sliding platen 5 in preparation for the next splicing operation. He then causes a signal to be sent to the packaging machine, for example by pressing a button, to indicate that the packaging machine may restart. As the new running web starts to move, the newly formed splice passes between the nip rollers and is compressed to ensure a good joint.

Depending on the design of the machine, and operator safety, it may be possible to restart the packaging machine before loading the new reel into the reel-changing apparatus and fastening its leading end to the second sliding platen.

Figure 13:
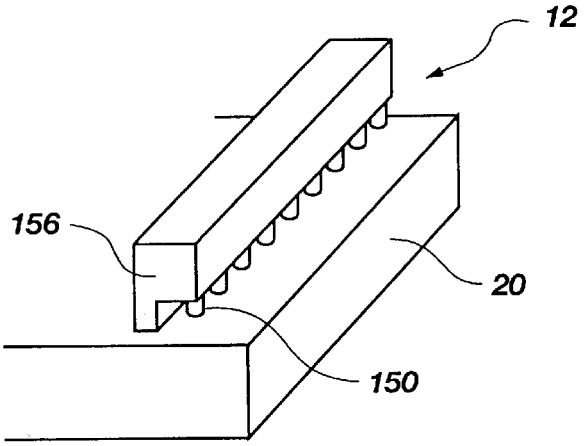
FIGS. 13 and 14 are perspective views from above and below respectively of a splicing means according to a third embodiment incorporating a row of punches.
Figure 15:
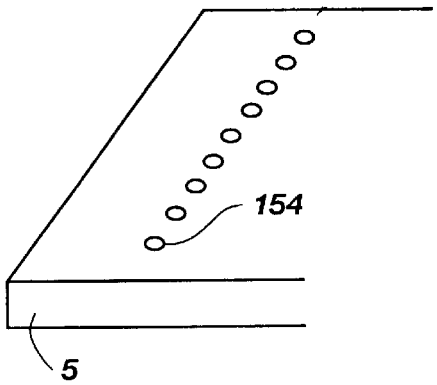
FIG. 15 is a perspective view of a sliding platen according to the third embodiment incorporating a row of punch-receiving holes; and, FIG. 16 is a perspective view of a web provided with a discontinuous adhesive strip.
Figure 14:
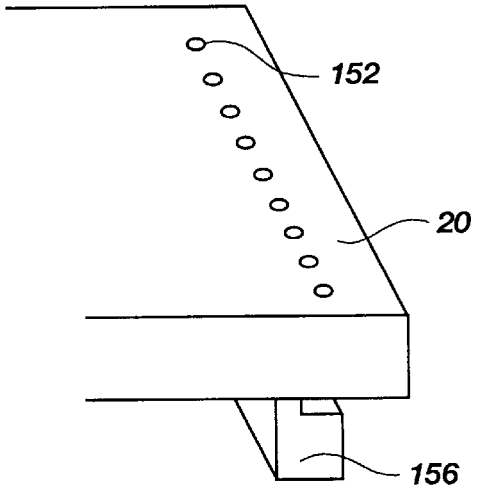

In a preferred, third, embodiment, a row of holes may be punched through the splice between two webs in order to cause a package integrity monitoring means in a downstream food packaging machine to discard automatically packages incorporating the splice. This may be achieved as shown in FIGS. 13,14 and 15 by providing the splicing means 12 with a row of punches 150 which can extend through rows of corresponding holes 152, 154 in the third platen 20 and in the abutting sliding platen 5 or 11 (shown as 5 in FIG. 15) during splicing. (The vacuum clamp holes in the platens have been omitted from FIGS. 13 to 15). The punches are mounted in a punch driving means 156, which may drive the punches in any convenient manner, such as by manual or electromechanical or pneumatic or hydraulic means. While the opposed platens are pressed together during splicing, the punches are driven through the splice to form a row of holes in the splice. The punches fit snugly in the holes in the platens so that holes are cut cleanly in the splice, in the manner of an office hole-punch for forming holes in paper. The discs of material punched from the splice are removed via the holes in the sliding platen. It is important that the holes are cleanly cut to prevent any distorted splice material around the hole edges from interfering with the passage of the web through the packaging machine. The nip rollers, if used in association with the punch means, may help to flatten any distorted splice material around the hole edges.

Holes may be punched in any pattern but must be spaced such that all food packages incorporating a portion of the splice are rejected.

Figure 16:
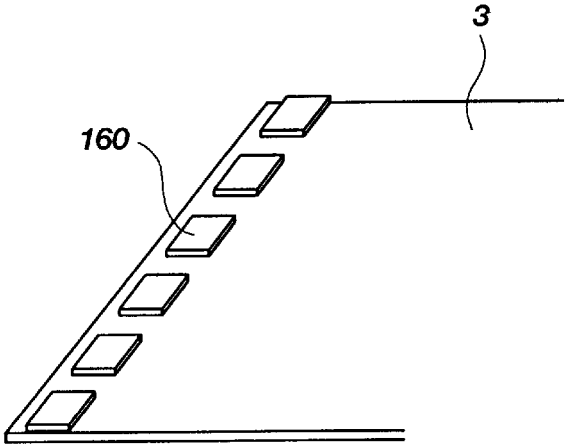

A similar effect may be achieved according to a further preferred embodiment of the invention by using intermittent adhesive on the web material. An example is illustrated in FIG. 16, which shows the end of a web 3 carrying a discontinuous strip of adhesive 160. The adhesive cover strip may still be continuous, for ease of removal.

Splicing may, if desired, be carried out by means other than the adhesive strips used in the embodiments described herein. For example welding may be appropriate for certain web materials.

I claim:

1. A reel change apparatus for supplying a webbing material to a downstream machine comprising:

two reel holding means each arranged to hold a reeled web/webbing material, one in a material supply position and the other in a wait position, a first set of rollers arranged to guide webbing material from the reel in the material supply position over a first platen and towards the downstream machine, a second set of rollers arranged to guide wedding material from the reel in the wait position to a second platen; and a splicing means from which a running web can pass, in operation, to a downstream machine, the splicing means comprising a pivotable third platen and a retaining means for retaining or clamping a trailing end of a running web onto the pivotable platen;

wherein the first and second platens are sliding platens positioned upstream of the splicing means, each including retaining means for retaining or clamping onto the respective sliding platen a leading end of a new web from a respective reel, such that an adhesive provided on the leading end is exposed and is supported by the respective sliding platen, and each of the sliding platens being substantially linearly slidable between a respective standby position and a respective splicing position; and wherein the leading end of a new web can be retained or clamped onto one sliding platen in the respective standby position while a running web passes over the other sliding platen to the downstream machine, and when the trailing end of the running web is retained or clamped onto the pivotable platen, the one sliding platen is slidable to the respective splicing position and the pivotable platen is pivotable to bring the trailing end of the running web into contact with the leading end of the new web to form a splice by sandwiching the adhesive therebetween, and subsequently to release the splice.

2. A reel change apparatus according to claim 1, in which at least one of said retaining means includes a vacuum clamp.

3. A reel change apparatus according to claim 1, in which at least one of said retaining means includes an offset roller.

4. A reel change apparatus according to claim 1, further comprising an end detector to detect an end of said webbing material from said reel in said supply position.

5. A reel change apparatus according to claim 1, further including a means provided in association with said third platen to puncture holes through said webbing material in the region of said splicing so that packs formed by said packaging machine including said splice are not sealed to enable the packs with puncture holes in the splice to be rejected.

6. A reel change apparatus according to claim 1, further including a slicing means for cutting said trailing end prior to joining said trailing end to said leading end.

7. A reel change apparatus according to claim 1, further including an accumulator or end link adjuster having a spring-biased roller to reduce tugging of said webbing material by picking up webbing material which is slack when said webbing material is not being pulled into said packaging machine and giving out slack as said webbing material is pulled.

8. A reel change apparatus according to claim 1, in which at least one of said retaining means includes a pneumatic clamp.

9. A reel change apparatus according to claim 1 in which said third platen may be raised clear of said webbing material.

10. A splicing apparatus comprising;

two spools, each for carrying a respective reeled web/webbing material;

two sliding platens, each for receiving and supporting a web from one or other of said spools, and each comprising a clamp for clamping said web thereto; and, a splicing means comprising a pivotable third platen and a clamp for clamping a web thereto;

each of said sliding platens being substantially linearly slidable between a respective standby position spaced from said splicing means and a respective splicing position in which said sliding platens are interoperable with said splicing means so that, in operation, while a running web is passing from one of said spools over one of said sliding platens and through said splicing means, a leading end of said web from said other spool can be clamped to said other sliding platen in the respective standby position, and when said running web ends, a trailing end of said running web can be clamped to said pivotable platen, said other sliding platen can be moved to the respective splicing position and said splicing means operated to form a splice between said trailing end and said leading end.

11. A splicing apparatus according to claim 10, further comprising a punch means associated with said splicing means for punching one or more holes through said splice.

12. A splicing apparatus according to claim 10, in which each said sliding platen moves along a respective sliding direction oriented so that each sliding platen in the respective standby position is spaced from a respective running web passing over said sliding platen.

13. A splicing apparatus according to claim 12 in which each said sliding platen moves along a respecting sliding direction set at less than 10 degrees to the direction of said respective running web.

14. A splicing apparatus according to claim 10, in which said sliding platens slide along respective sliding directions which are at an acute angle to each other.

15. A splicing apparatus according to claim 14 in which said angle is less than 50 degrees.

16. A splicing apparatus according to claim 15 in which said angle is about 40 degrees.

17. A splicing apparatus according to claim 16 in which said angle is about 6 degrees.

18. A splicing apparatus according to claim 10 in which said third platen may be raised clear of said webbing material.

19. A splicing apparatus according to claim 10, in which at least one of said clamps is a pneumatic clamp.

20. A reel-change apparatus comprising;

two reel-holding means each arranged to hold a reeled web/webbing material;

two sliding platens, each including a means for retaining or clamping a leading end of a new web thereon; and a splicing means mounted downstream of said sliding platens and from which a running web can pass, in operation, to a downstream machine, said splicing means comprising a pivotable third platen and a means for retaining or clamping a trailing edge of a running web onto said pivotable platen;

in which each of said sliding platens is substantially linearly slidable into a respective splicing position and, when one of said sliding platens retaining said leading end is positioned in the respective splicing position, said pivotable platen is pivotable to bring said trailing end into contact with said leading end and to form a splice therebetween, and subsequently to release said splice.

21. A reel change apparatus according to claim 20, in which at least one of said retaining or clamping means is a pneumatic clamp.

22. A reel change apparatus according to claim 20, in which said splicing means comprises a punch means for forming one or more holes through said splice.

23. A reel-change apparatus according to claim 20, in which said leading end is provided with an adhesive strip which is exposed when said leading end is retained on one of said sliding platens and is pressed between said trailing end and said leading end to form said splice.

24. A reel change apparatus according to claim 23, in which said adhesive strip is discontinuous or intermittent.

25. A reel change apparatus according to claim 20 in which said third platen may be raised clear of said webbing material.

* * * * *